US005971174A

United States Patent [19]

Strock

[11] Patent Number: 5,971,174

[45] Date of Patent: Oct. 26, 1999

[54] STACKABLE MODULAR DISPLAY RACK

[76] Inventor: Douglas J. Strock, 3939 Monroe Rd., Midland, Mich. 48642

[21] Appl. No.: 08/854,426

[22] Filed: May 12, 1997

[51] Int. Cl.[6] ..... A47B 43/00

[52] U.S. Cl. ..... 211/186

[58] Field of Search ..... 211/186, 188, 211/133.1, 126.2

[56] References Cited

U.S. PATENT DOCUMENTS

| | | | |
|---|---|---|---|
| 2,738,883 | 3/1956 | Wineman . | |
| 3,115,253 | 12/1963 | Malbin et al. . | |
| 3,208,406 | 9/1965 | Maslow . | |
| 3,381,533 | 5/1968 | Kellogg . | |
| 3,977,528 | 8/1976 | Berger . | |
| 4,099,472 | 7/1978 | Kellogg | 211/186 |
| 4,467,927 | 8/1984 | Nathan | 211/186 |
| 4,836,393 | 6/1989 | Maye . | |
| 4,847,461 | 7/1989 | Gilmore . | |
| 5,013,100 | 5/1991 | Zich . | |
| 5,411,153 | 5/1995 | Unfried | 211/186 |
| 5,695,081 | 12/1997 | Alkalay | 211/186 |

*Primary Examiner*—Alvin Chin-Shue
*Assistant Examiner*—Sarah Purol
*Attorney, Agent, or Firm*—Robert L. McKellar

[57] ABSTRACT

A stackable modular display rack that is easily assembled and disassembled and which is intended for the display of small or delicate articles. The rack described herein is readily disassembled without any tools and can be so disassembled and packed conveniently for shipment.

16 Claims, 4 Drawing Sheets

STACKABLE MODULAR DISPLAY RACK

The invention disclosed and claimed herein deals with a stackable modular display rack that is easily assembled and disassembled and which is intended for the display of small or delicate articles. The rack described herein is readily disassembled without any tools and can be so disassembled and packed conveniently for shipment.

BACKGROUND OF THE INVENTION

This invention deals with a stackable modular display rack for the display of small and/or delicate articles.

There are a fair number of shelving systems and demountable racks illustrated in the prior art. All seek to provide a product that is easily assembled and disassembled in order to move and ship the product. One such system is shown in U.S. Pat. No. 2,738,883, which issued to Wineman on Mar. 20, 1956 in which there is shown a demountable rack for storing stock and equipment. The system includes shelf sections using upright corner posts which are right angle triangular, tubular sections, which are used to connect the parts together.

In U.S. Pat. No. 3,115,253, which issued on Dec. 24, 1963 to Malbin, et al., there is shown a shelving system which is a nested ladder, in which the various shelves are linked together by vertical support posts which are insertable into holes drilled into the shelves themselves.

Yet another shelving system is shown in U.S. Pat. No. 3,208,406, which issued on Sep. 28, 1965 to Maslow in which a metal clip is used to clip together vertical rods of adjacent like shelving in order to hold the units together.

Still another prior art device is that shown in U.S. Pat. No. 3,381,533, which issued on Aug. 27, 1974 to Kellogg in which there is disclosed a free-standing shelf system which uses vertical posts to bind the shelves together.

Another device of the prior art is that shown in U.S. Pat. No. 3,977,528, which issued to Berger on Aug. 31, 1976 in which there is shown a tubular type of display rack assembly having tubular support members joined by coupling means which are tubular configurations affixed to the upright posts, which in themselves have posts, to which are affixed tubular shelving.

One of the closest devices with regard to the instant invention is that shown in U.S. Pat. No. 4,836,393, which issued on Jun. 6, 1989 to Maye, in which flat shelves, each containing an aperture in each corner thereof, accept a vertical post to support one shelf from the other. It should be noted with regard to this reference, that the device shown therein does not have any provision for binding one modular display stand to another.

There is shown in U.S. Pat. No. 4,847,461, which issued on Jul. 11, 1989 to Gilmore, a stackable plate arrangement for microwave dishes, which arrangement is for use in microwave ovens. The shelves are configured to swing on one common post, and rest on two similar posts. There is no provision for binding two or more of these shelves together to form a shelving system.

Finally, there is shown in U.S. Pat. No. 5,013,100, which issued to Zich on May 7, 1991, a multi-part shelf which is supported mainly by vertical rods, and in which the various units are held together by what is described by the inventor as an articulation connection, which is a flat plate having two holes in it to provide for the insertion of the vertical rods and their subsequent coupling with either the vertical rod above it or below it.

None of the devices of the prior art provide the benefits of the instant invention.

THE INVENTION

The invention herein deals with a modular display rack that is easily assembled and disassembled without the use of tools. Thus, the invention is a stackable modular display rack which comprises in combination at least two display units each comprising (A) at least one shelf unit, (B) at least three support rods for (A), (C) at least one support base and, (D) at least one support rod connector, wherein each (A) is generally a flat plate member having at least three corners, a top surface and a bottom surface.

Further, each corner has an aperture through it to accommodate a connector pin and each aperture has a connector pin mounted through it. Each connector pin has a top end and a bottom end, and there is a well in each of the top end and bottom end. Each well has an interior surface and a bottom, and the interior surface has threads on it.

Each of the support rods (B) has a length equal to each of the other rods being used in each given layer or shelf of the rack and each rod has two ends. Each of the ends has a threaded stub on it. The threads on one end of the threaded stubs are left-handed threads and the threads on the threaded stub on the opposite end of the support rod are right-handed threads.

Each support rod connector is comprised of a semi-tubular connector selected from a group consisting of (i) a two-way semi-tubular connector (ii), a three-way semi-tubular connector and, (iii) a four-way semi-tubular connector, wherein (i) is comprised of two, semi-tubular segments each having an open front, a closed back, and two closed sides, the two, semi-tubular segments being fixedly attached to each other at their respective backs.

The part (ii) is comprised of three, semi-tubular segments each having an open front, a closed back, and two closed sides, the three, semi-tubular segments being fixedly attached to each other, two of such segments being fixedly attached at their respective backs, and the third segment being attached by its back to one side of one of the other two segments to form the three-way semi-tubular connector.

Part (iii) is comprised of four, semi-tubular segments each having an open front, a closed back, and two closed sides, the four, semi-tubular segments being fixedly attached to each other at their respective backs to form the four-way semi-tubular connector.

Each connector (D) is mounted on a support rod through the open front such that the semi-tubular connector essentially surrounds the support rod. The semi-tubular connectors (D) each have a length shorter than the length of the support rod on which it is mounted.

DETAILED DESCRIPTION OF THE INVENTION

There is provided a modular display rack for the exhibition of small or delicate articles and a means of joining individual display units of such a rack without the use of tools and which can be secured to any smooth, flat horizontal surface. The rack can be readily disassembled and the support rods and the rack can be packed easily for shipment of the rack. The rack may be made of metal, wood, plastic, or other rigid materials, or a combination thereof, with the connectors being made principally of metal, plastic or rubber. According to this invention, there is provided a plurality of panels or shelves which may be square, rectangular, or triangular, and also contemplated within the scope of this invention are hexagonal or round or other such similar shapes, as long as there are at least three or more equally spaced connection points around the perimeter of the shelves, to essentially be effective as "corners" for connecting and supporting the shelves. For any one construction of the rack, the shelves are of the same size and shape, although various combinations of shapes and sizes can be used in adjacent display units. Moreover, the supporting rods for the shelving, with regard to any one given units, must be essentially the same length in order to allow the rack to be stable.

Threaded holes in the panels receive threaded ends of supporting rods which support the shelves. The rods, even though shown as being essentially round herein, can be, for example, square or ellipsoidal in configuration.

Assembled display units can be quickly connected to other assembled display units to create a system of shelving. Such display units may have two or more stacked shelves to create a display unit which may be used to display small articles on a desktop, or the like, in a display case, or any similar area.

Figure 1:
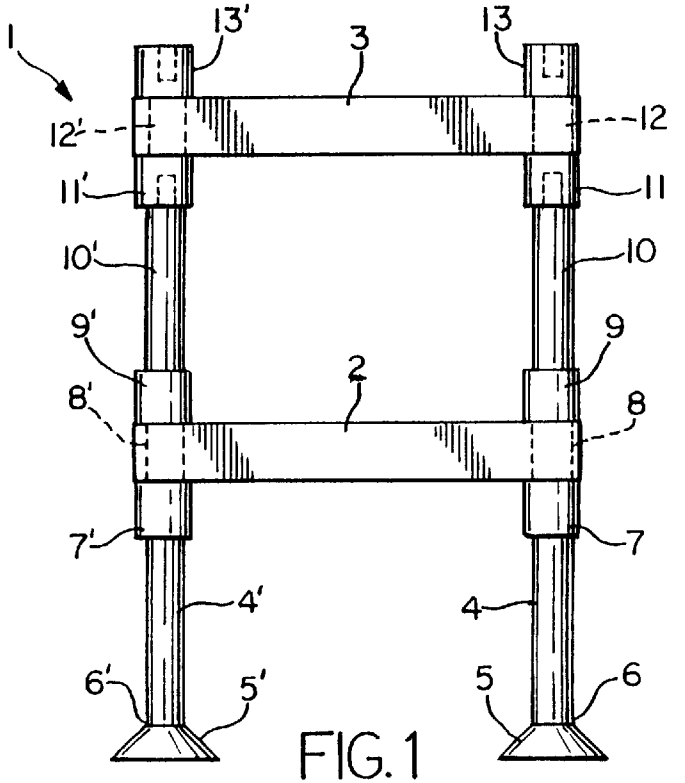
FIG. 1 is a full side view of a display rack of this invention.

With regard to FIG. 1, there is shown a single display unit 1 having two stacked shelves 2 and 3. With respect to the lower shelf 2, there is further shown two support rods 4 and 4', which are affixed to individual bases 5 and 5', respectively. For purposes of illustration, the support rods 4 and 4' are shown in a round configuration and the individual bases 5 and 5' are shown as suction cups, which attach readily to a smooth surface.

It is contemplated by the inventor herein, that the support rods 4 and 4' are on the order of about 4 to about 6 inches in length.

The lower ends 6 and 6' of the supporting rods 4 and 4' are threaded into the bases 5 and 5' respectively by threaded stubs 20 which will be discussed in detail infra.

The upper ends 7 and 7', respectively, are in turn threaded into the connecting pins 8 and 8' in order to support the shelf 2 in a stable condition. Threaded into the upper ends 9 and 9', of the connecting pins 8 and 8', respectively, (shown partially in phantom), are additional support rods 10 and 10', which will support the shelf 3 by threading into the bottom ends 11 and 11', respectively of additional connector pins 12 and 12', respectively (also shown partially in phantom).

It should be noted at this point, that the upper ends 13 and 13', respectively, of connecting pins 12 and 12', can be further utilized to add additional layers of shelving to the display rack 1.

Figure 2:
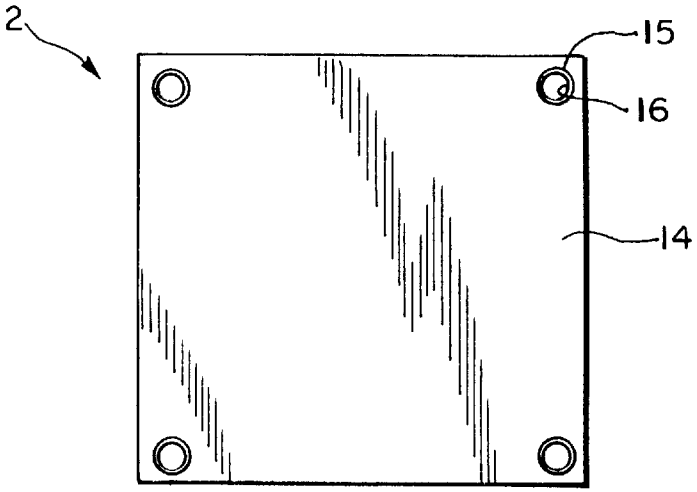
FIG. 2 is a full top view of a shelf of this invention.
Figure 3:
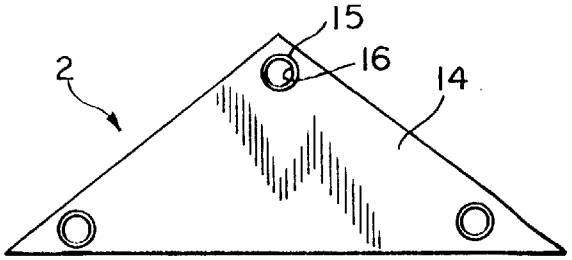
FIG. 3 is a full top view of another configuration of a shelf of this invention which is triangular.
Figure 4:
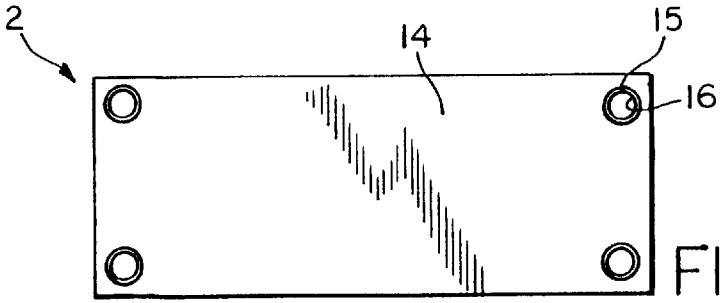
FIG. 4 is a full top view of another configuration of a shelf of this invention which is rectangular.
Figure 5:
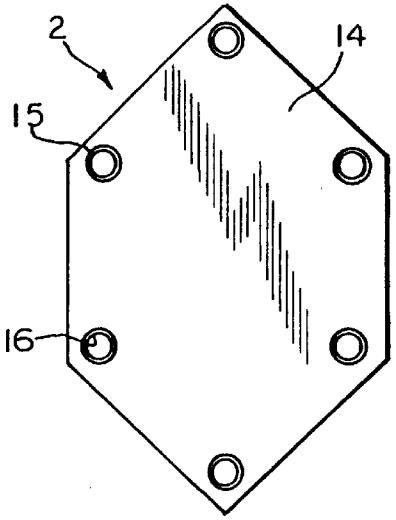
FIG. 5 is a full top view of another configuration of a shelf of this invention which is hexagonal.

The shelves 2 and 3 are essentially identical, but have been separately numbered to clarify the discussion related to the display unit 1. An example of a square shelf of this invention is shown in FIG. 2 in which there is shown the top surface 14, the apertures 15 in the corners thereof, and the threads 16 on the inside surface of the apertures 15. There is further shown the preferred configurations for the shelves 2, that is, in FIG. 2 is shown a square configuration. In FIG. 3 is shown a triangular configuration, and in FIG. 4, is shown a rectangular configuration, and in FIG. 5, there is shown a hexagonal configuration wherein at least "four" corners are formed.

Figure 6:
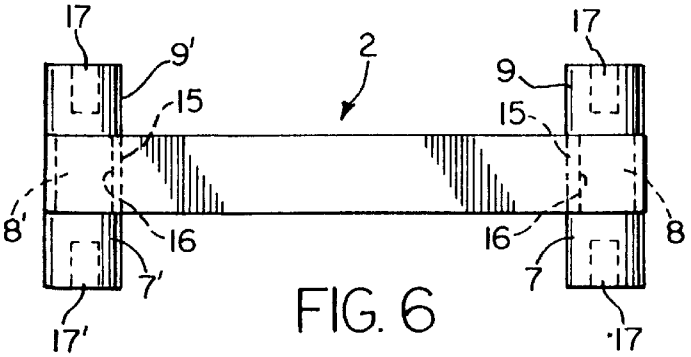
FIG. 6 is a full side view of a shelf of this invention.

With reference to FIG. 6, there is shown a side view of one of the shelves 2 of this invention showing the connecting pins 8 and 8', the lower ends 7 and 7', respectively of the connecting pins 8 and 8', and the upper ends 9 and 9', respectively of the connecting pins 8 and 8'. Shown in phantom in the ends 7, 7', 9 and 9', are the apertures 15, and the wells 17, containing the threads 16, thereon.

Figure 7:
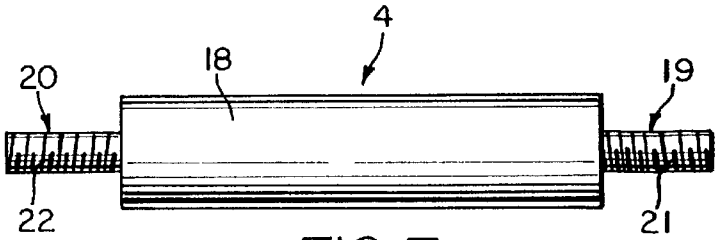
FIG. 7 is full enlarged side view of a supporting rod of this invention.

Shown in FIG. 7 is an enlarged support rod 4, which is illustrative of the support rods useful in this invention. The rod 4 is shown in a rounded configuration, but as indicated supra, the rod 4 can have any shape which accommodates the connectors of this invention. The rod 4 consists of the barrel 18, and the threaded stubs 19 and 20. The threads 21 on 19 are right-handed threads, and the threads 22 on 20, are left-handed threads which accommodate the assembly and disassembly of the display unit 1.

Figure 8:
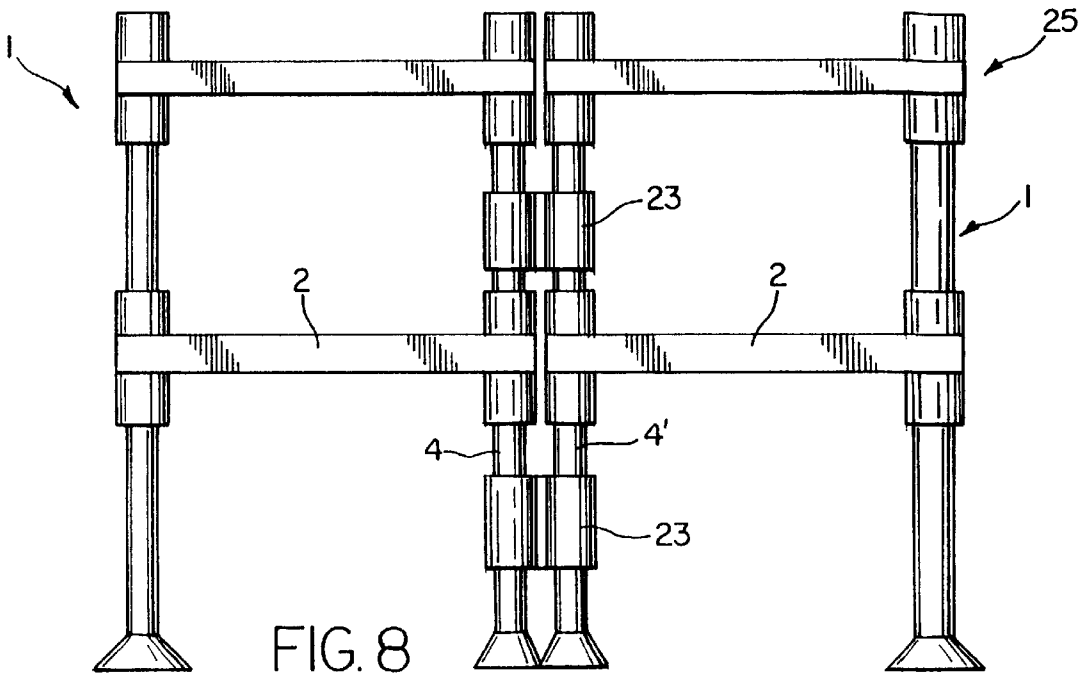
FIG. 8 is a full side view of a display rack of this invention.

As indicated supra, the display units 1 can be configured from one or many shelves and they can also be connected together to form a display rack 25 such as is shown in FIG. 8.

The connecting of the display units 1 to form the display rack 25 is accomplished by connecting the display units 1 together using the connectors 23 or 24, or a combination of them.

Figure 9:
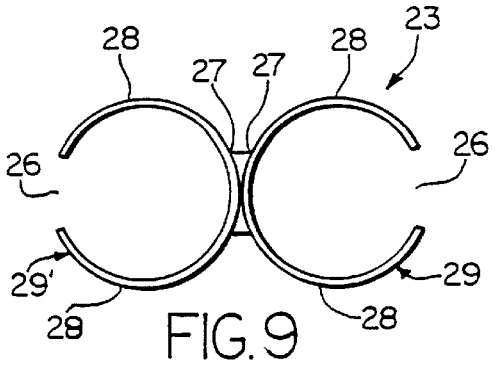
FIG. 9 is a full top view of the two-way semi-tubular connector of this invention.

For example, in FIG. 9, which is top view, there is shown the connector 23, which is a two-way, semi-tubular connector being comprised of two, semi-tubular segments 29 and 29', each having an open front 26, a closed back 27, and two closed sides, 28, it being understood that the designations "front", "back" and "sides" are general in nature to more clearly illustrate the invention, it being further understood, that with circular, or rounded configurations, there is no specific front, back or sides. It should be noted that the two semi-tubular connectors 29 and 29'are bound to each other by their respective backs 27.

Figure 10:
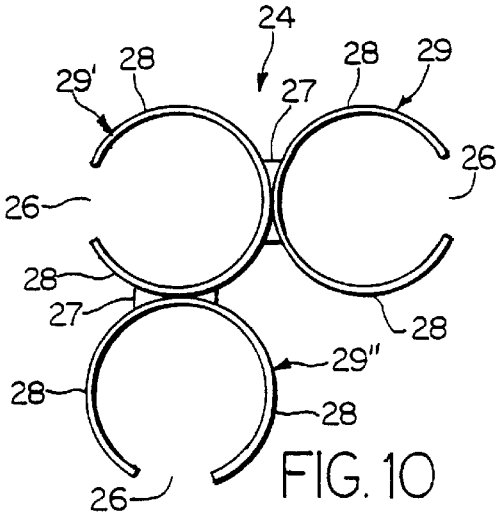
FIG. 10 is a full top view of the three-way semi-tubular connector of this invention.

With respect to FIG. 10, there is shown a top view of the three-way semi-tubular connector 24 being comprised of three, semitubular segments 29, 29', and 29", each having an open front 26, a closed back 27, and two closed sides 28, with the same understanding as set forth just supra with regard to the circular configuration. It should be noted that two of the semi-tubular segments, i.e. 29 and 29' are bound to each other by their respective backs 27, while the third semi-tubular segment 29" is bound to segment 29' by its back 27, only it is connected to segment 29' at one of its sides 28. It should be apparent to those skilled in the art that this configuration will allow alternate connections, by simply turning it from end to end.

Figure 11:
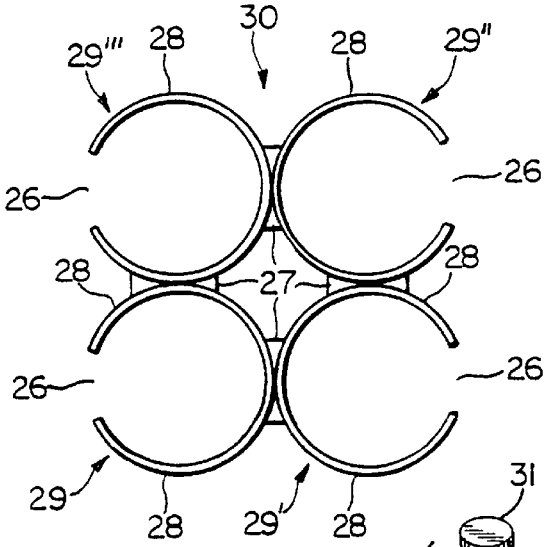
FIG. 11 is a full top view of the four-way semi-tubular connector of this invention.

With respect to FIG. 11, there is shown a full top view of a four-way semi-tubular connector 30 being comprised of four, semi-tubular segments 29, 29', 29", and 29''', each having an open front 26, a closed back 27, and two closed sides 28, with the same understanding as set forth just supra with regard to the circular configuration. It should be noted that all four of the semi-tubular segments, are bound to each other by their respective backs and one side so as to allow the open fronts 26 to point outwardly.

The three-way semi-tubular connector 24 allows the display units 1 to be connected at a right angles to the each other to allow creation of an irregular display rack 25.

Figure 12:
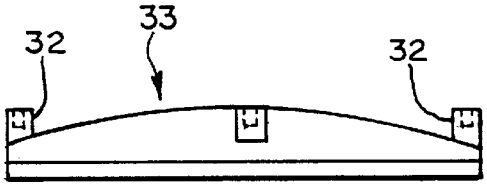
FIG. 12 is a full side view of a unitary base of this invention.

The display rack 25, comprised of two display units 1, is thus illustrated in FIG. 8 and connectors 23 are illustrated therein. As shown, the display rack 25 has individual bases 5, but each of the display units 1 can have a unitary base 31 such as is shown in FIG. 12. The unitary base has receptacles 32 for connector rods such as 4 of FIG. 1.

Figure 13:
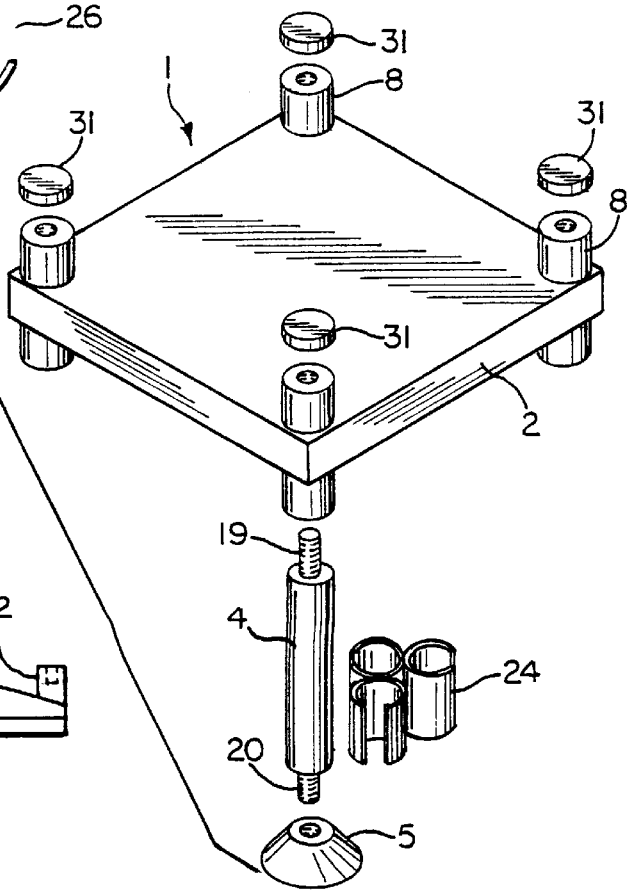
FIG. 13 is an exploded view in perspective of a shelf, support rod, base, and three-way semi-tubular connector of this invention.

Further, the use of the three-way semi-tubular connector 24 is illustrated in FIG. 13, which is an exploded view of a display rack 1 having a three-way semi-tubular connector 24 placed thereon. The second display unit 1 is not shown for the sake of clarity.

Figure 14:
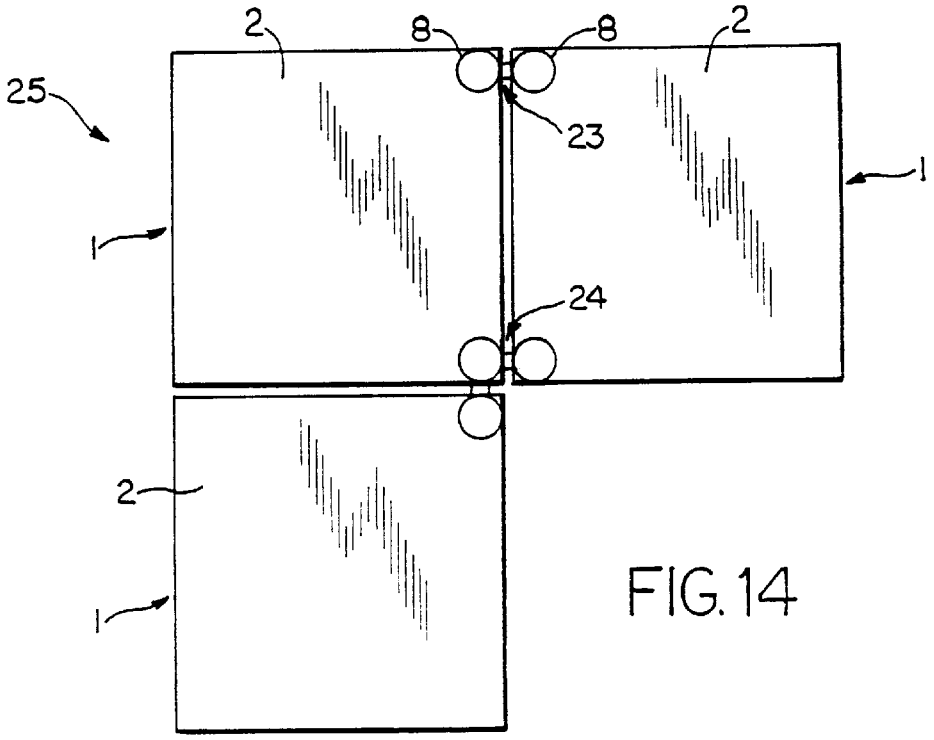
FIG. 14 is a full top view of a display rack of this invention comprised of three display units, one two-way semi-tubular connector and one three-way semi-tubular connector.

In FIG. 14, there is shown a top view of a display rack 25, showing a right angle configuration using three display units 1, a connector 23 and a connector 24.

Figure 15:
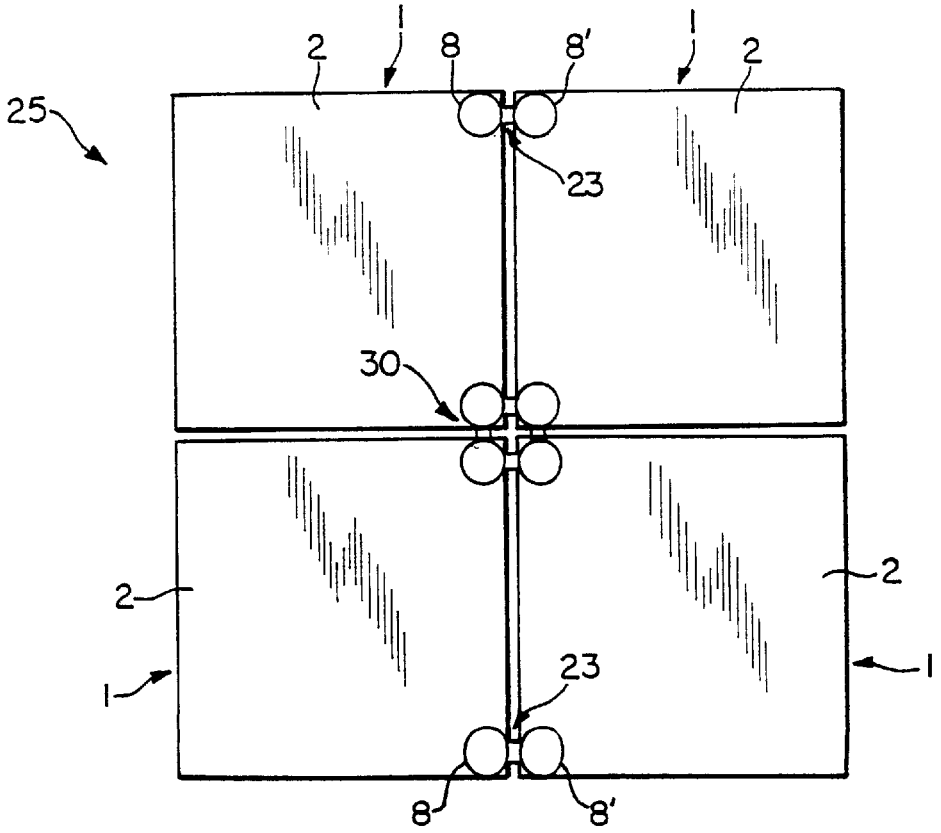
FIG. 15 is a top view of a display rack 25, showing a square configuration using four display units 1, connectors 23 and 30.

In FIG. 15, there is shown a top view of a display rack 25, showing a square configuration using four display units 1, two connectors 23, and a connector 30.

Although not required for this invention, it is contemplated within the scope of this invention to have caps 31 to cover the open wells 17 (FIG. 13) in order to provided aesthetics to the display, but to keep dust and dirt out of the wells and protect any threads that may be located therein. Obviously, these caps 31 would only be used on the upper most pins 8.

Figure 16:
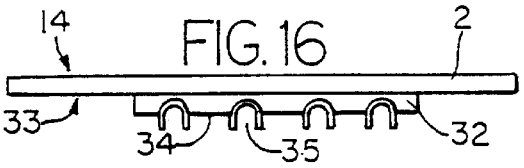
FIG. 16 is a side view of a shelf of this invention showing the tray holder for the support rods.

Turning now to FIG. 16, it is contemplated within the scope of this invention to provide a shelf 2, having a rod holder tray 32 attached to the bottom surface 33 thereof for holding the connector rods 4 of this invention. Such rods 4 can be simply stored in this tray 32, or the rods 4 can be carried in the rod holder tray 32 for shipping purposes. As shown, the rod holder tray 32 has in its surface 34, three or more cup-shaped channels 35, in which the rods 4 are held.

What is claimed is:

1. A stackable modular display rack comprising in combination at least two display units each comprising (A) at least one shelf unit;

(B) at least three support rods for (A)

(C) at least one support base and, (D) at least one support rod connector, wherein each (A) is generally a flat plate member having at least three corners, a top surface and a bottom surface;

each corner having an aperture through the top surface and through the bottom surface thereof to accommodate a connector pin therethrough;

each aperture having a connector pin mounted therethrough, each said connector pin having a top end and a bottom end, there being a well in each of the top end and bottom end, each well having an interior surface and a bottom, each said interior surface having threads thereon;

each of the support rods (B) being of equal length and each said rod having two ends, each end thereof having a threaded stub thereon, the threads on the threaded stubs on one end being a left-handed thread and the threads on the threaded stub on the opposite end of the support rod being right-handed threads;

each support rod connector being comprised of a semi-tubular connector selected from a group consisting of (i) a two-way semi-tubular connector, (ii) a three-way semi-tubular connector, and (iii) a four-way semi-tubular connector, wherein (i) is comprised of two, semi-tubular segments each having an open front, a closed back, and two closed sides, the two, semi-tubular segments being fixedly attached to each other at their respective backs;

(ii) is comprised of three, semi-tubular segments each having an open front, a closed back, and two closed sides, the three, semi-tubular segments being fixedly attached to each other, two of such segments being fixedly attached at their respective backs, and the third segment being attached by the back to one side of one of the other two segments to form the three-way semi-tubular connector;

(iii) is comprised of four, semi-tubular segments each having an open front, a closed back, and two closed sides, the four, semi-tubular segments being fixedly attached to each other at their respective backs and at least one side, to form the four-way semi-tubular connector;

each said connector (D) being mounted on a support rod through the open front such that the semi-tubular connector essentially surrounds said support rod;

the semi-tubular connectors (D) having a length shorter than the length of the support rod on which it is mounted.

2. The rack as claimed in claim 1 wherein the base is a unitary base.

3. The rack as claimed in claim 1 wherein there is a single base for each such rod.

4. The rack as claimed in claim 1 wherein each connector is made of spring metal.

5. The connector of claim 4 wherein the metal is spring steel.

6. The connector of claim 4 wherein the metal is aluminum.

7. The rack as claimed in claim 1 wherein each connector is made of plastic.

8. The connector as claimed in claim 7 wherein the plastic is polyethylene.

9. The connector as claimed in claim 8 wherein the polyethylene is crosslinked polyethylene.

10. The rack as claimed in claim 1 wherein the connector is made of rubber.

11. The rack as claimed in claim 1 wherein each shelf is made of metal.

12. The rack as claimed in claim 1 wherein each shelf is made of plastic.

13. The rack as claimed in claim 1 wherein each shelf is made of wood.

14. The rack as claimed in claim 1 wherein all of the components are made of plastic.

15. The rack as claimed in claim 1 wherein all of the components are made of metal.

16. In combination:

(i) a shelf unit, said shelf unit being a generally flat plate member having a top surface and a bottom surface;

(ii) a tray mounted on the bottom surface of the shelf unit, said tray being configured to accept and hold three or more support rods (B) of claim 1, said configuration not exceeding the length of the longest support rod (B) placed therein.

* * * * *